US009456728B2

(12) United States Patent
Danestad et al.

(10) Patent No.: US 9,456,728 B2
(45) Date of Patent: Oct. 4, 2016

(54) VACUUM CLEANER

(71) Applicant: Aktiebolaget Electrolux, Stockholm (SE)

(72) Inventors: Ulrik Danestad, Huddinge (SE); Allan Persson, Norrköping (SE); Fredrik Sjöberg, Bromma (SE)

(73) Assignee: Aktiebolaget Electrolux (SE)

( * ) Notice: Subject to any disclaimer, the term of this patent is extended or adjusted under 35 U.S.C. 154(b) by 0 days.

(21) Appl. No.: 14/351,365

(22) PCT Filed: Oct. 12, 2012

(86) PCT No.: PCT/EP2012/070331
§ 371 (c)(1),
(2) Date: Apr. 11, 2014

(87) PCT Pub. No.: WO2013/053920
PCT Pub. Date: Apr. 18, 2013

(65) Prior Publication Data

US 2014/0230184 A1 Aug. 21, 2014

(30) Foreign Application Priority Data

Oct. 13, 2011 (SE) ..... 1100756

(51) Int. Cl.
*A47L 5/10* (2006.01)
*A47L 11/00* (2006.01)
(Continued)

(52) U.S. Cl.
CPC ..... *A47L 11/4097* (2013.01); *A47L 5/22* (2013.01); *F04D 29/4253* (2013.01); *F04D 29/444* (2013.01)

(58) Field of Classification Search
CPC .... A47L 11/4097; A47L 5/22; F04D 29/444; F04D 29/542; F04D 29/544; F04D 29/44
See application file for complete search history.

(56) References Cited

U.S. PATENT DOCUMENTS 2,726,807 A * 12/1955 Lewis ..... A47L 7/0009 15/320
3,334,370 A 8/1967 Boyd
(Continued)

FOREIGN PATENT DOCUMENTS

CN 1975175 6/2007
EP 1790264 5/2007
(Continued)

OTHER PUBLICATIONS

International Search Report for PCT Application No. PCT/EP2012/070331 dated Jan. 30, 2013.
(Continued)

*Primary Examiner* — Bryan R Muller
(74) *Attorney, Agent, or Firm* — RatnerPrestia

(57) ABSTRACT

A vacuum cleaner comprising an electric motor, an impeller and an axial diffuser arranged on a common axis is provided. The impeller is connected to the electric motor and is arranged for rotation on the common axis to achieve a radial air flow. The radial air flow is redirected into an axial air flow. The diffuser passages are arranged between an inner circumferential wall and an outer circumferential wall, wherein the walls are coaxially arranged around the common axis. Each diffuser passage is delimited in a circumferential direction between the walls by vanes extending between the inner wall and the outer wall and in an axial direction extending substantially in parallel with the common axis. The vanes are arranged in at least two rows being consecutively arranged in the axial direction extending substantially in parallel with the common axis.

13 Claims, 5 Drawing Sheets

(51) Int. Cl.

| | |
|---|---|
| ***A47L 5/00*** | (2006.01) |
| ***A47L 9/00*** | (2006.01) |
| ***A47L 11/40*** | (2006.01) |
| ***F04D 29/42*** | (2006.01) |
| ***F04D 29/44*** | (2006.01) |
| ***A47L 5/22*** | (2006.01) |

(56) References Cited

U.S. PATENT DOCUMENTS

| | | | | |
|---|---|---|---|---|
| 3,791,772 | A | 2/1974 | Keimpema et al. | |
| 4,065,233 | A | 12/1977 | Torigoe et al. | |
| 5,152,661 | A * | 10/1992 | Sheets | 415/84 |
| 5,401,146 | A | 3/1995 | Moriya et al. | |
| 5,511,942 | A | 4/1996 | Meier | |
| 6,055,700 | A | 5/2000 | Holsten et al. | |
| 6,077,032 | A | 6/2000 | Wolfe, Jr. et al. | |
| 6,158,083 | A | 12/2000 | Holsten | |
| 6,264,427 | B1 | 7/2001 | Berfield | |
| 6,358,005 | B1 | 3/2002 | Berfield | |
| 6,442,792 | B1 | 9/2002 | Sudou et al. | |
| 6,485,259 | B2 | 11/2002 | Berfield | |
| 6,659,737 | B2 | 12/2003 | Bader et al. | |
| 6,839,934 | B2 * | 1/2005 | Houghton et al. | 15/329 |
| 7,025,576 | B2 | 4/2006 | Chaffee | |
| 7,942,646 | B2 | 5/2011 | Zhou et al. | |
| 2007/0122277 | A1 | 5/2007 | Oh | |
| 2012/0186036 | A1 * | 7/2012 | Kegg | A47L 5/22 15/347 |

FOREIGN PATENT DOCUMENTS

| | | |
|---|---|---|
| EP | 1 878 376 | 1/2008 |
| EP | 2 316 322 | 5/2011 |
| JP | 59-213994 | 12/1984 |
| JP | 06-108999 | 4/1994 |
| JP | 11294390 | 10/1999 |
| WO | WO 2004/062457 | 7/2004 |
| WO | 2012103053 | 8/2012 |

OTHER PUBLICATIONS

Office Action, with English translation, for Chinese Application No. CN201280050333.4 dated Sep. 6, 2015.

Translation of Notice of Reasons for Rejection for Japanese Application No. 2014535111, dated Jun. 7, 2016, 3 pages.

* cited by examiner

VACUUM CLEANER

This application is a U.S. National Phase application of PCT International Application No. PCT/EP2012/070331, filed Oct. 12, 2012, and claims the benefit of Swedish Application No. SE 1100756-4, filed Oct. 13, 2011, both of which are incorporated herein by reference.

TECHNICAL FIELD

The present invention relates to vacuum cleaners, and especially to a vacuum cleaner comprising an axial diffuser.

BACKGROUND

The efficiency of the motor-fan unit is an important factor when it comes to minimize losses in a vacuum cleaner. A part of the fan system where present systems show unnecessary losses is in the air guiding system. Usually, a diffuser is present for deceleration of air ejected from an impeller in a controlled manner, in this way transforming the dynamic pressure created by the impeller into static pressure. Diffusers in vacuum cleaners are either arranged axially or radially. The construction of the diffuser is very important as it affects the efficiency of the vacuum cleaner. A highly efficient diffuser can increase the volume of air being moved or reduces the power required to move the same volume of air. Hence, the desire for a more efficient diffuser is obvious.

In EP 1 878 376 a vacuum cleaner with a radially arranged diffuser is provided. In the known arrangement, the efficiency is increased by changing the inlet angles of the vanes in the diffuser, when combined with changing the return guide vane angles. Radially arranged diffusers result in a vacuum cleaner with large diameter and therefore axially arranged diffusers are preferred when a more compact design is desired. For example in handheld vacuum cleaners where size is an important factor, axial diffusers allow for a design with a smaller outer diameter than radially arranged diffusers.

U.S. Pat. No. 6,442,792 describes a vacuum cleaner with a mixed flow impeller directly connected to an electric motor and with an axial diffuser arranged on the downstream side of the impeller.

A general problem in diffusers is that deceleration of air should be as smooth as possible to minimize losses. By increasing the flow area in the diffuser air channels little by little smooth deceleration is achieved. This is easier to achieve if the air channels are relatively long. A problem when producing diffusers with long channels is that the production tools end up to be very complex. For example, when producing diffusers by injection moulding, the injection moulding tool needs to be extremely complex to produce a diffuser provided with air channels long enough to provide smooth deceleration of air. Another problem arising in long flow channels and in flow channels where the cross sectional area is increased, is boundary layer separation; the air flow will separate from the flow surface it follows, resulting in an increased flow resistance and increased losses. In an arrangement with one diffuser row with relatively long vanes there is a risk that the boundary layers are decelerated and stop thereby creating separation.

Further, for battery operated vacuum cleaners where the available energy usually is limited either by cost and/or space restrictions, there is a need for a compact efficient motor-fan unit with as low losses as possible. Accordingly, there is a need for an improved vacuum cleaner providing both a compact design as well as an efficient fan system with low losses.

SUMMARY

An object of the present invention is to provide an improved vacuum cleaner solving at least some of the problems mentioned above.

According to a first aspect of the invention, the object is achieved by a vacuum cleaner comprising an electric motor, an impeller and an axial diffuser arranged on a common axis. The impeller is connected to the electric motor and is arranged for rotation on the common axis to achieve a radial air flow. The radial air flow is redirected into an axial air flow. The diffuser passages are arranged between an inner circumferential wall and an outer circumferential wall. The walls are coaxially arranged around the common axis. Each diffuser passage is delimited in a circumferential direction between the walls by vanes extending between the inner wall and the outer wall in an axial direction extending substantially in parallel with the common axis. The vanes are arranged in at least two rows being consecutively arranged in the axial direction extending substantially in parallel with the common axis.

Since the vanes are arranged in at least two consecutive rows, the flow surface is interrupted. The air stream will follow the interrupted flow surface for a longer distance compared to a non-interrupted surface of the same length since the transition between the rows will promote a stable boundary layer along the vanes of the downstream row. As a result, unwanted separation of the air flow from the flow surface will be avoided and the air flow will be distributed over the whole available cross sectional area of the diffuser passages. Thereby, unnecessary losses are avoided and the losses in the diffuser are thereby limited. The above mentioned object is thereby achieved. In an arrangement with a plurality of consecutive diffuser rows the separation and losses is minimized because new fresh boundary layers are created on the surfaces of the downstream vanes. It has been shown that a plurality of diffuser rows give a higher working efficiency than a single row.

In embodiments the vanes are arranged in more than two consecutive arranged rows. By using further rows, the effect of interrupting the flow surface as described above will be further improved. Further, due to the rows there will be a smooth increase of the cross sectional area of the diffuser passages resulting in smooth deceleration of the air stream.

In embodiments at least two pair of vanes are arranged in the consecutively arranged rows.

In embodiments the first pair of vanes is arranged at a first angle in relation to the common axis, and the second pair of vanes is arranged at a second angle in relation to the common axis. The second angle is smaller than the first angle. Thereby, the passage width between the two vanes comprised in a pair for each consecutive row is increasing, and the cross sectional area of the diffuser passage, and thus the flow area of the air stream flowing in the passage, is increasing in the air flow direction.

In embodiments the vanes comprised in the first pair are arranged substantially in parallel and at a distance from each other.

In embodiments the second pair of vanes is arranged with a displacement in a circumferential direction in relation to the first pair of vanes.

In embodiments the displacement has a length of the distance multiplied with 0.15-0.35.

In embodiments the electric motor is driven by a battery.

In embodiments the vacuum cleaner is of an upright model.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Figure 1:
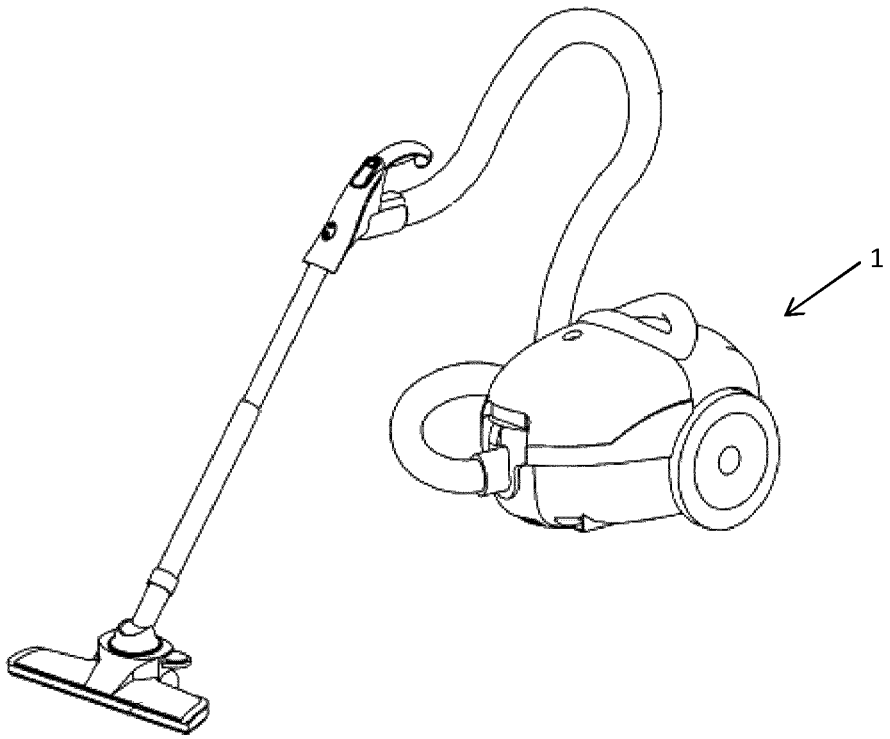
FIG. 1 illustrates a traditional vacuum cleaner.

FIG. 1 illustrates a conventional vacuum cleaner. The vacuum cleaner 1 comprises a cleaner body with a motor-fan system comprising an impeller and a diffuser. Typically, such vacuum cleaner has a body with a relatively large diameter which at least partly depends on the diffuser being radially arranged, with air channels arranged radially outside the impeller.

Figure 2:
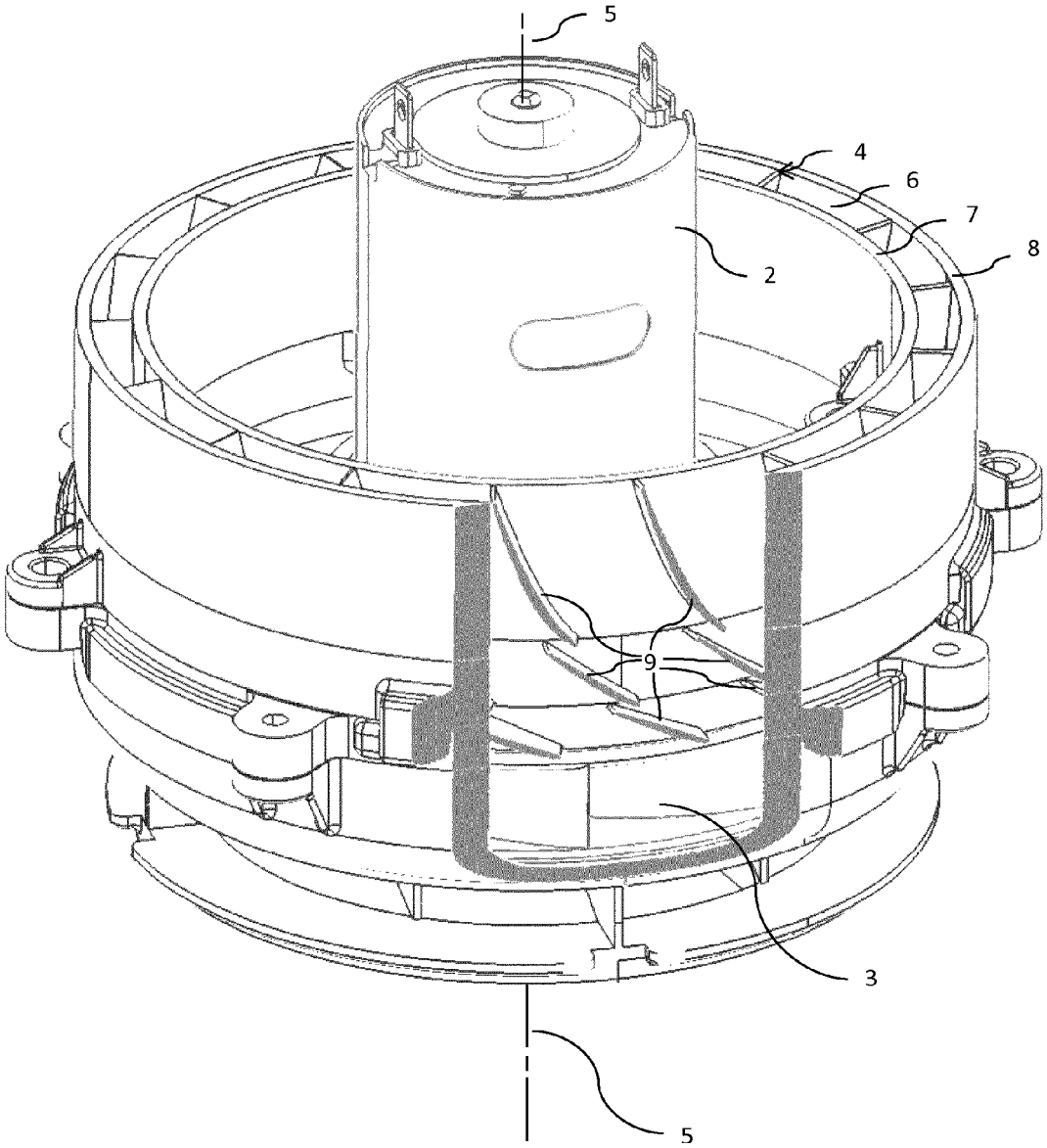
FIG. 2 illustrates the interior of a vacuum cleaner in accordance with an embodiment of the present invention.

FIG. 2 illustrates the interior of a vacuum cleaner 1 in accordance with the present invention. The vacuum cleaner 1 comprises an electric motor 2, an impeller 3 and an axial diffuser 4 being arranged on a common axis 5. The impeller 3 is connected to the electric motor 2 and is arranged for rotation on the common axis 5 to achieve a radial air flow. The axial diffuser 4 comprises a plurality of diffuser passages 6. The radial air flow is redirected into an axial air flow. To achieve the axial air flow, the radial air flow is redirected in a vaneless space (not shown) between the impeller and the diffuser. The axial diffuser 4 is arranged to deflect the substantially tangential velocity of the air exiting the vaneless space into a more axial direction. The diffuser passages 6 are arranged between an inner circumferential wall 7 and an outer circumferential wall 8. The walls 7, 8 are coaxially arranged around the common axis 5. Each diffuser passage 6 is delimited in a circumferential direction by vanes 9 arranged between the inner wall 7 and the outer wall 8 and extending at partially in an axial direction in parallel with the common axis 5. The vanes 9 in the embodiment shown are arranged in three consecutive rows 10*a*, 10*b*, 10*c*. However, the vanes 9 may be arranged in an arbitrary number of consecutive rows, depending on the specific vacuum cleaner to be designed.

Figure 3A:
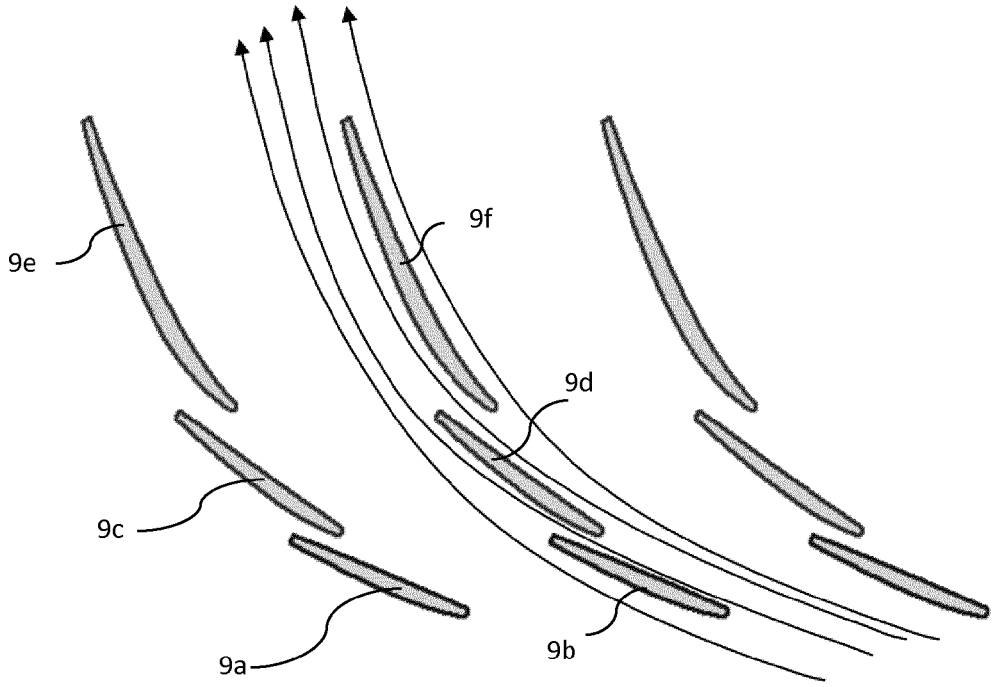
FIGS. 3*a* and 3*b* illustrates details of the diffuser vanes in an embodiment of the present invention.
Figure 3B:
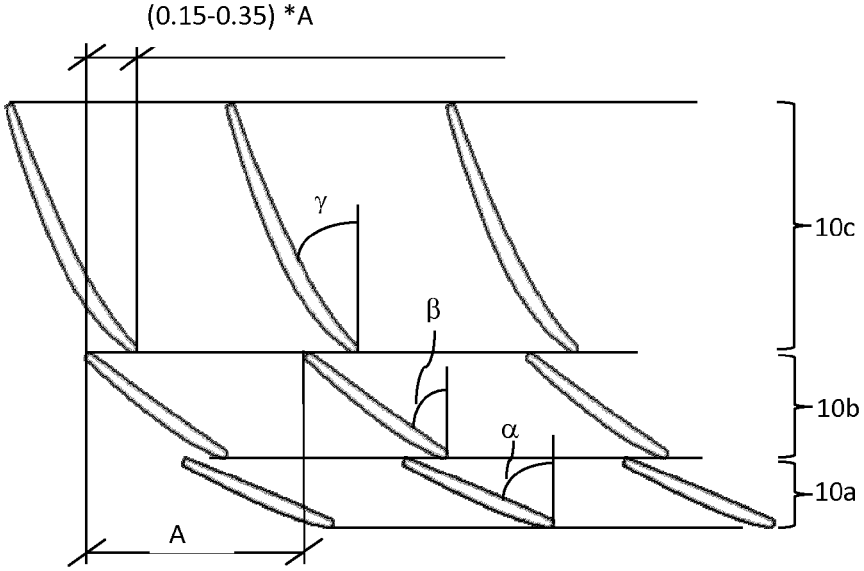

FIGS. 3*a* and 3*b* illustrates details of the arrangement of the diffuser vanes 9 delimiting the diffuser passages 6 in the circumferential direction. The main direction of the air flow is shown by arrows. In the specific embodiment shown, the vanes 9 are arranged in pairs in three consecutive rows 10*a*, 10*b*, 10*c*. The vanes 9, comprised in a pair, are arranged substantially in parallel with each other. The first pair of vanes 9*a*, 9*b* is arranged at a first angle $\alpha$ in relation to the common axis 5. The second pair of vanes 9*c*, 9*d* is arranged at a second angle $\beta$ and the third pair of vanes 9*e*, 9*f* is arranged at a third angle $\gamma$ in relation to the common axis 5. For each row 10*a*, 10*b*, 10*c*, the angle of the vanes 9 is decreased whereby the passage width between the two vanes comprised in a pair for each consecutive row 10 is increasing. Thereby, the cross sectional area of the diffuser passage 6, and thus the flow area of the air stream flowing in the passage, is increasing in the air flow direction. Thanks to the arrangement of the vanes 9, a smooth increase of the flow area is achieved. The first vanes 9*a*, 9*b* comprised in the first pair will be arranged at a distance A from each other as well as the second vanes (9*c*, 9*d*) comprised in the second pair.

Still further, the second pair of vanes 9*c*, 9*d* is arranged with a displacement in a circumferential direction in relation to the first pair of vanes 9*a*, 9*b*. Typically, the displacement is chosen to be 0.15-0.35 of the distance A. In addition to the initially mentioned manufacturing advantages, the displacement serves to ensure that a stable flow of air is maintained in a large part of the diffuser passage 6. As described above, a vane 9*d* upstream of an adjacent vane 9*f* will guide the air flow over the adjacent vane 9*f* as well as providing a slot. Through the slot air from an adjacent diffuser passage will pass and promote stable boundary layer along the adjacent vane 9*f*.

Figure 4:
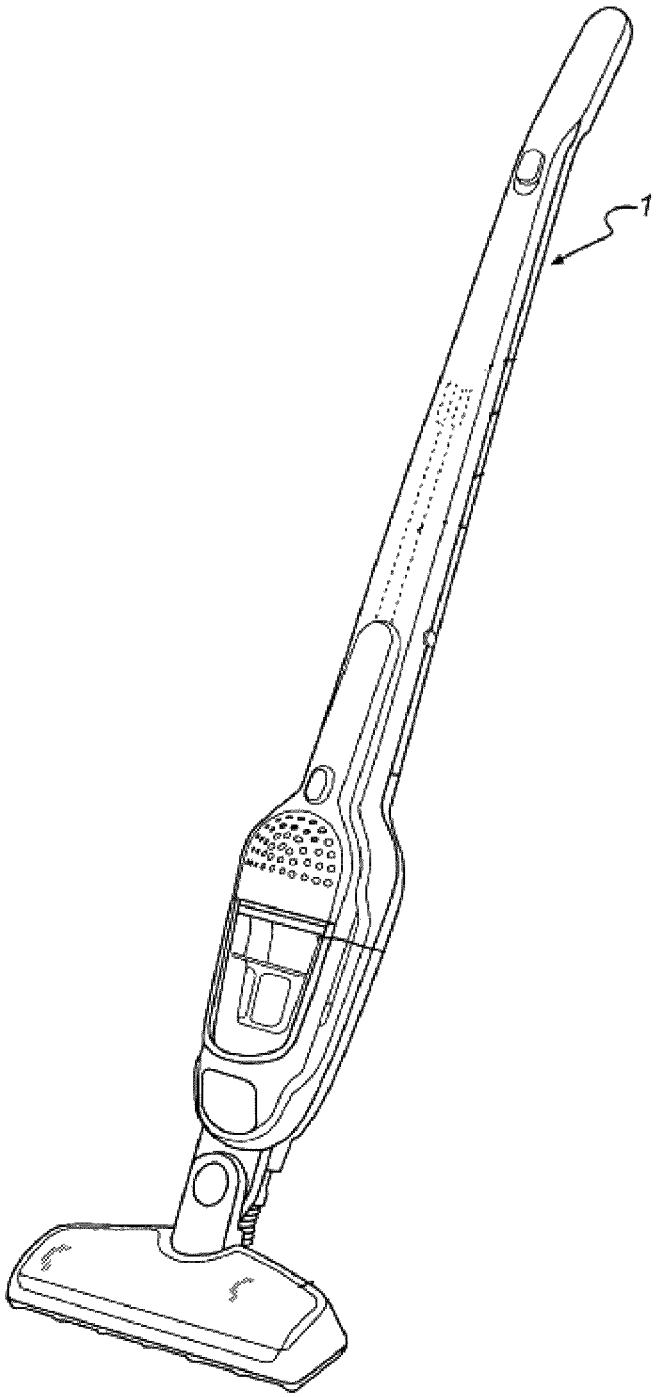
FIG. 4 illustrates a vacuum cleaner of an upright model.

FIG. 4 illustrates a vacuum cleaner 1 of a handheld upright model. As is realised from the drawing, a design with a large diameter will be bulky and thus uncomfortable and inconvenient for the user. Therefore, a vacuum cleaner of an upright model is another example of a vacuum cleaner with improved design when implementing the present invention.

Figure 5:
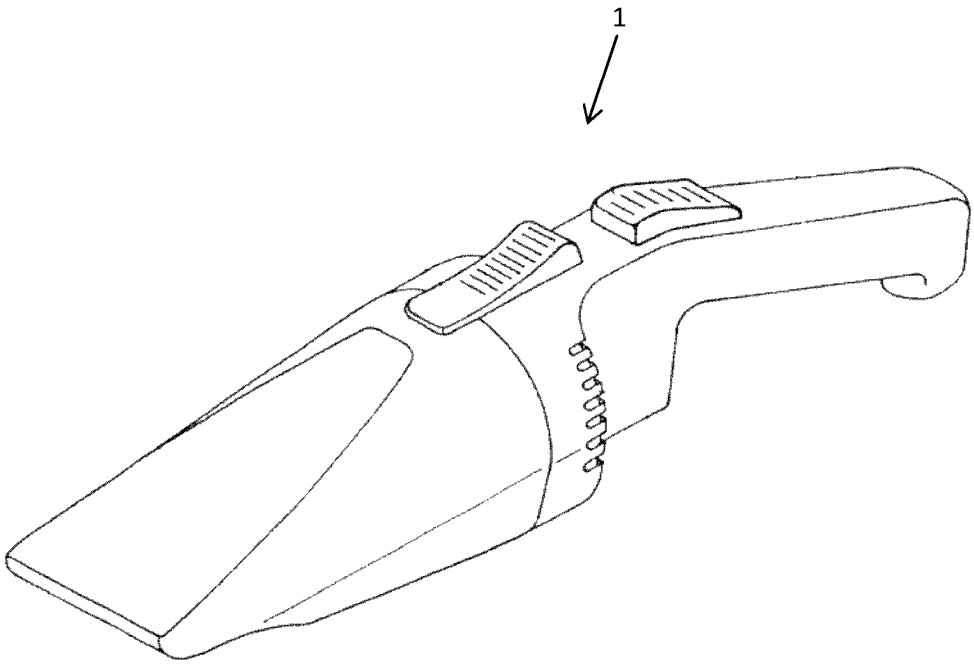
FIG. 5 illustrates a vacuum cleaner of a battery driven handheld model.

FIG. 5 illustrates a vacuum cleaner 1 of a handheld model. Vacuum cleaners of this type are typically driven by an integrated rechargeable battery or are arranged to be driven by the battery of a vehicle, such as a car battery. The available power is thus limited. Still further, for the user to experience comfortable and easy use of the vacuum cleaner, the design needs to be compact and slim. Such a vacuum cleaner is thus an example of a vacuum cleaner of improved design when implementing the present invention.

Example embodiments described above may be combined as understood by a person skilled in the art. Although the invention has been described with reference to example embodiments, many different alterations, modifications and the like will become apparent for those skilled in the art. Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

The invention claimed is:

1. A vacuum cleaner comprising:

an electric motor, an impeller and an axial diffuser being arranged on a common axis, the impeller being connected to the electric motor and arranged for rotation on the common axis to achieve a radial air flow, the axial diffuser being configured to redirect the radial air flow into an axial air flow;

the diffuser comprising an inner circumferential wall that is spaced from the motor and an outer circumferential wall that is spaced from the inner circumferential wall, the inner circumferential wall and the outer circumferential wall being coaxially arranged around the common axis and extending from a diffuser inlet adjacent the impeller to a diffuser outlet that is spaced from and surrounds the electric motor, and wherein the inner circumferential wall and the outer circumferential wall terminate at the diffuser outlet at substantially the same point along the common axis;

the diffuser further comprising a plurality of diffuser passages extending from the diffuser inlet to the diffuser outlet, each diffuser passage being delimited in a circumferential direction between the inner circumferential wall and the outer circumferential wall by vanes extending between the inner circumferential wall and the outer circumferential wall; and wherein at least one diffuser passage comprises:

a first pair of vanes configured to receive air leaving the impeller, the first pair of vanes being arranged substantially in parallel with one another at a first angle in relation to the common axis, a second pair of vanes located downstream of the first pair of vanes and configured to direct air exiting the diffuser in an axial direction, the second pair of vanes being arranged substantially in parallel with one another at a second angle in relation to the common axis, and each of the second pair of vanes being located with respect to a respective one of the first pair of vanes to form a respective interrupted flow surface, and wherein a cross sectional area of the diffuser passage smoothly increases in the airflow direction from an inlet of the diffuser to an outlet of the diffuser.

2. A vacuum cleaner according to claim 1, wherein the vanes are arranged in more than two consecutively arranged rows in the axial direction.

3. A vacuum cleaner according to claim 1, wherein the first pair of vanes is arranged at a first angle $\alpha$ in relation to the common axis, and the second pair of vanes is arranged at a second angle $\beta$ in relation to the common axis, the second angle $\beta$ being smaller than the first angle $\alpha$.

4. A vacuum cleaner according to claim 3, wherein the second pair of vanes is arranged with a displacement in a circumferential direction in relation to the first pair of vanes.

5. A vacuum cleaner according to claim 1, wherein the second pair of vanes is arranged with a displacement in a circumferential direction in relation to the first pair of vanes.

6. A vacuum cleaner according to claim 5, wherein the displacement is equal to a value of 0.15 to 0.35 multiplied with a distance between the vanes comprised in a pair.

7. A vacuum cleaner according to claim 1, wherein the electric motor is driven by a battery.

8. A vacuum cleaner according to claim 1, wherein the vacuum cleaner comprises an upright vacuum cleaner.

9. A vacuum cleaner according to claim 1, wherein the at least one diffuser passage further comprises a third pair of vanes located downstream of the first pair of vanes and upstream of the second pair of vanes.

10. A vacuum cleaner according to claim 1, wherein the inner circumferential wall and the outer circumferential wall are parallel from the diffuser inlet to the diffuser outlet.

11. A vacuum cleaner according to claim 1, wherein the plurality of diffuser passages extend from the diffuser inlet to the diffuser outlet.

12. A vacuum cleaner according to claim 1, wherein the first pair of vanes is adjacent the diffuser inlet.

13. A vacuum cleaner according to claim 1, wherein the second pair of vanes is adjacent the diffuser outlet.

* * * * *